United States Patent [19]

Vogel

[11] Patent Number: 4,611,414

[45] Date of Patent: Sep. 16, 1986

[54] SKIBOOT

[76] Inventor: Raimund W. Vogel, Lierstr. 25, D 8 Munich 19, Fed. Rep. of Germany

[21] Appl. No.: 506,095

[22] Filed: Jun. 20, 1983

[30] Foreign Application Priority Data

Jul. 19, 1982 [DE] Fed. Rep. of Germany ..... 3226969
Feb. 21, 1983 [DE] Fed. Rep. of Germany ..... 3305930

[51] Int. Cl.[4] ..... A43B 5/04
[52] U.S. Cl. ..... 36/120; 36/119
[58] Field of Search ..... 36/117–121, 36/105

[56] References Cited

U.S. PATENT DOCUMENTS 3,313,046 4/1967 Werner et al. ..... 36/119
3,405,463 10/1968 Werner ..... 36/121
4,152,849 5/1979 Frechin et al. ..... 36/120

FOREIGN PATENT DOCUMENTS 2807348 8/1979 Fed. Rep. of Germany ..... 36/120
2407681 6/1979 France ..... 36/119
2433311 3/1980 France ..... 36/121

*Primary Examiner*—James Kee Chi

[57] ABSTRACT

A ski boot made of hard parts in the form of a shell and a cuff, which are joined together by levers reinforcing the sides of an upper of said ski boot, such levers having joints. The levers running laterally from said cuff down to the sole of said boot and are joined to a pullroad which is connected to a force transmitting element, which element is placed in front of at least one resilient compression element for braking, the forward bending movement of a lower leg in said boot.

20 Claims, 7 Drawing Figures

SKIBOOT

BACKGROUND OF THE INVENTION

The present invention relates to a ski boot as described in the first part of claim one.

It is possible that although many of the shortcomings in ski boot designs have been partially resolved by advances in the prior art, it has so far not been possible despite in many years of work by both the ski boot industry and the present inventor since 1964 to make a functional ski boot design.

THE PURPOSE OF THE INVENTION

The purpose of the present invention is in fact to create a ski boot with desired properties, namely:

(a) The property of keeping the ankle joint free for forward bending of the lower leg in the ski boot towards the toe of the boot, of braking and stopping such forward bending around the ankle joint simply by the development of a resistance increasing to Nm 200 as the lower leg is bent forwards, such motion coming to an end at a forward limit of up to about 40° of the lower leg in relation to the foot sole.

(b) A well-enough damped and free return of the bending forces of the lower leg without the skiers movements, being hampered by the boot.

(c) Side stiffness of the upper shaft part of the boot, later called cuff.

(d) Lightness.

(e) Small dimensions.

(f) Produced expediently and economically.

(g) Most boot parts have but one special and independent function.

(h) Increased safety.

(i) Economical use of the skier's energy.

(j) The desired mechanical operations are functional independent of weather conditions.

DISCUSSION OF THE INVENTION IN LIGHT OF THE PRIOR ART

The booklet "Skifahren—aber mit sicherer Ausrü stung" (Skiing—See That Your Gear is Safe") issued by the Bavarian Ministry of State for Labor and Social Order, November 1981, highlights some of the purposes behind the development of the present invention. No specific design is therein described which would enable to produce a ski boot with such desirable characteristics.

The German Offenlegungsschrift No. 2,807,348 concerns a ski boot having some points in common with the present invention with a hinged gripping cuff jointed to the lower part of the boot, the cuff having limbs towards the sole and joined with a spring placed in the area of the sole. One end of the spring is joined to the sole whereas the other end is joined with the limb ends as noted. The limbs of the cuff and the side faces of the curved lower part of the boot upper are curved three-dimensionally. For that reason the cuff is not able to be angled forward about its joint (as was in fact the purpose of the design), because the two sheet-like broad limbs are rested tightly against the lower part of the upper. If, and nothing is said about this in the specification, they were not to be curved, the end of the limbs would have to be turned upwards away from the boot sole, which in the case of a limb length of 120 mm as measured from the joint would be 9 mm if the cuff were only angled through 20° and would be 30 mm if the angling were 40°. However, in a sole of normal size, taking into account the height of the spring, there would not be enough space for such motion of the end of the limbs. And if a resilient compression element made of rubber were to be used as a spring, the design in the said specification would have a take-up space for the spring with guide slots to let through the one end of the limbs. However, when loaded, the rubber then would be squeezed and rendered useless in the slots. Although one of the purposes of this design was to degrease the friction between the lower part of the boot upper and the cuff, this was not in fact possible with the details given in the working example of this previous boot design. Because the cuff and the lower part of the upper were apparently constructed for thermoplastic material, which had the further function of clothing the foot and lower leg, this material would necessarily also have to be soft enough that the two parts (said upper and cuff) could resist snow and water entry. This being the case, the material would not have the property of transmitting sufficient forces from the lower leg to the ends of that limbs, without itself being deformed.

The ski boot of this specification may be able to be bent forwards up to approximately 2° in the elastic deformation range of the curved plastic limbs, whereas in fact the lower leg may, in view of its structure be bent forwards by about 40°.

Furthermore the different sorts of resilient elements or buffering parts do not have a great enough damping effect as will be described infra. This previous ski boot design cannot achieve the same results as the present invention.

The German Offenlegungsschrift No. 2,316,443 shows a ski boot with splints to be placed in front or in back of the lower leg and which are joint to a hard shell placed partly around the foot at the ankle. Replaceable resilient elements between the splint and said shell are present to permit the leg to be bent forwards through an angle of (judging from the drawing) 18° at the most, such bending being suddenly stopped at the end of the range as so designed. The splints would have to be heavy in weight if they were to undertake the desired function of making the upper side stiff as well as acting as a gripping cuff for transmission of mechanical forces. Furthermore, splints of this kind are expensive. If rubber were to be used as a spring part in the ankle part of the upper, the rubber would have such a large dimension that there would hardly be enough space for it on or in the boot, if at the same time the boot were to have the property (a) as noted in the above list of purposes. The said specification does not delineate other parts of the purpose of the present invention or how they are to be effected.

Another previous ski boot, described in U.S. Pat. No. 3,410,006, has a hard shell placed partly around the foot and a gripping cuff, the cuff and the hard shell being hinged together by side stiff flat springs. The forward bending of the lower leg is only limited and sharply stopped by a metal band using a slot guide in the Achilles tendon part of the cuff. This metal band, however, has no role in building up a sufficient progressively increasing resistance.

The Swiss Pat. No. 611,138 has two stiff parts as an upper, which were generally the same as the hard shell and the cuff of the design of the German Offenlegungsschrift No. 2,807,348 or of the present invention. The two stiff parts to the upper were joined together by very heavy and complicated joints and were to be braked by steel springs or rubber stops while being angled forwards. If this "Swiss" boot were to be so designed that the angles of bending and the resistance thereto as desired in the purpose (a) of the list mentioned above, then tension springs with a weight of approximately 1230 g would have to be fixed at the boot. Together with fastening and reinforcing parts needed for transmission of the forces to the stiff parts of the upper, the overall weight of the boot would be increased by about 2 kg simply because of this spring system. If rubber buffers were to be used in place of metal springs, the bulk of the boot would be too large for effective skiing. The larger the size of a ski boot, the greater the resistance in the snow. In addition, the moving parts are covered by an outer sheath of soft material to keep the clothing and mechanical functions of the boot separate. This sheath does not function efficiently; it might for example be readily damaged by the edges of the skis.

STATEMENT OF INVENTION

It is clear that if all the design points of the prior art are uses together, the outcome will still not be a ski boot effecting the full purpose of the present invention. Claim one—second part—embodies in general the purpose of this invention.

The cellular resilient compression elements has, as one of its effects, the responsibility for a progressively increasing resistance, that generally increases linearly at first and then goes up to a level of at least Nm 200 (for a size 8 boot), dependent on the size of the compression element while at the same time making certain of a large enough damping effect and free return of the bending forces of the upper. The element for the transmission of compressive force (hereinafter "slide") ist responsible for turning the circular motion of the lever ends in the sole region into a straight-line motion parallel to the sole of the boot, and futhermore makes realisable a necessary way for compression of said element to get the said resistance of Nm 200 by a forwrad bending of the lower leg in the boot to about 40°, that is to say short of the limiting position of the lower leg at a point where its forward bending motion is limited at about 40° by the compression of said element.

The lever arms together with a torsionally-stiff cuff joined thereto make the upper side-stiff. The laterally stiff levers are best made of narrow leaf or strip spring material, the flat form thereof taking up less space laterally and making possible their bending althoug the side walls of the hard shell are curved. The levers are joined directly or indirectly with the hard shell. The levers may have the shape of the foot and the lower leg, resulting in a better laterally fixation of the lower leg. The resilient compression element is best placed in the back part of the sole region, where exists enough space due to the angle between the sole of the foot and the sole of the boot.

The resistance to the forward bending of the lower leg may be changed to the personal preferance of the skier by changing the resilient compression element (hereinafter "element") and the size of the take-up space for said element.

This element is relatively light; used in connection with the take-up spaces, it gives the full, necessary resistance to bending of the lower leg until the binding is opened, so that there is no sudden jarring effect, as is frequently the case with other ski boots. By a transmission of force from the lower lever ends by way of the front sole region to said element in the back part of the sole region, the shortcomings of the ski boot of the previous specification No. 2,807,348 which are caused by connection of the cuff limbs with the spring, are eliminated. This force transmission system in the present invention is made possible by the presence of a large enough space in the front part of the sole region, in which said slide needed for the transmission of the moments of Nm 200 may be housed without making the boot overly broad or its sole overly thick.

Because of the cell structure of said element which is optimally made of polyurethane, there is no or only limited change in the overall volume, unlike the case of solid rubber. If solid rubber is pressed in one direction it becomes perpendicularly broader.

By adjustment of the isocyanate level in the polyurethane and the gross density thereof it is possible to obtain almost any progressive spring characteristic line. For example at the outset the line is generally linear and then becomes progressive. The damping effect of polyurethane cellular bodies is about 20% and for this reason is ideal for a ski boot. Metal and rubber springs have a damping effect of 1% to 3% and they are of little use in ski boots if point (b) of above list of purposes is to be effected. The present ski boot will be easily modifiable by a simple replacement of said element, so that various users of a single pair of boots of this design will be able to adjust this single pair to their individual demands.

In keeping with the purpose of the invention each part of the ski boot is primarily designed for one function.

For this reason the parts of said boot may be produced singly, and they may be exchanged for other parts of the same species.

Some examples of the invention are seen in the following figures.

LIST OF DIFFERENT VIEWS OF THE FIGURES

DETAILED ACCOUNT OF WORKING EXAMPLES OF THE INVENTION

Figure 1:
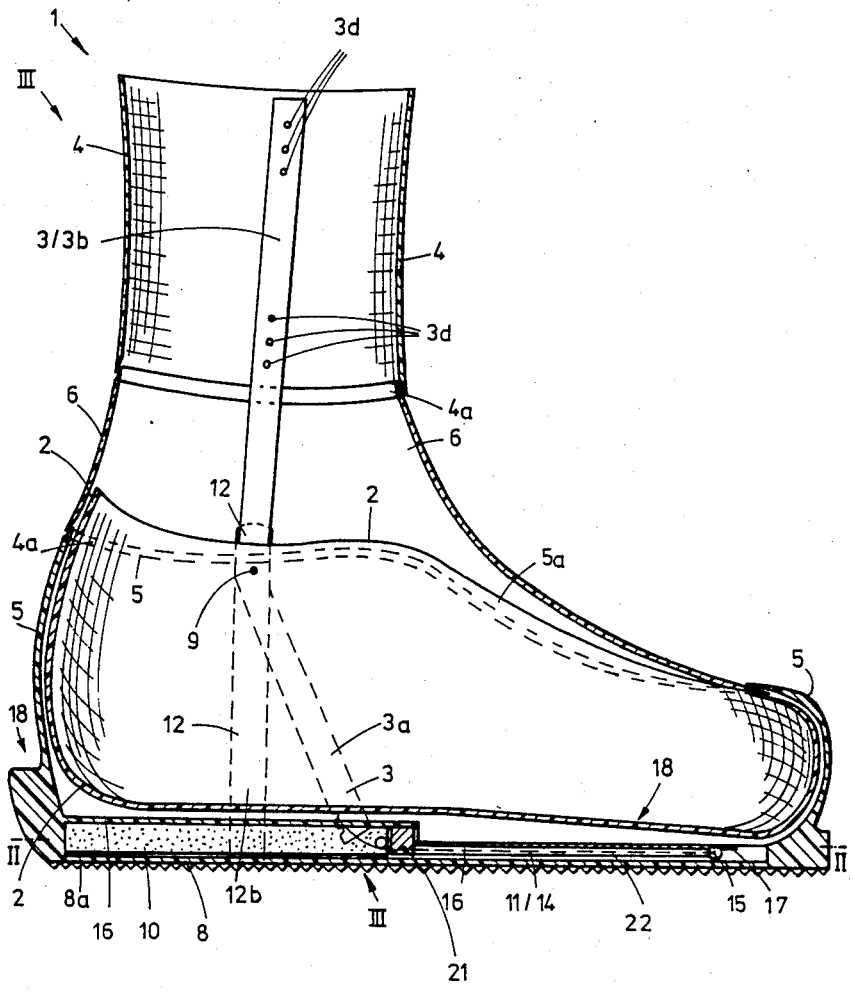
FIG. 1 is a view of a ski boot in a middle longitudinal section.

Turning now to the FIGS. 1 to 5 and more specially to FIG. 1, the ski boot 1 has a hard shell 5 on whose ankle parts levers 3 are pivoted and are made of flat spring steel strip, the levers 3 stretching downwards from a cuff 4 over the ankle part of the boot upper towards the sole part of the boot. Cuff 4 is fixed by rivets 3*d* with the upper lever part 3*b*. In the ankle part of the upper levers 3 are pivoted at a pivot point 9 on the hard shell 5 and joined up with two legs 12*b* of an U-like base part 12, that for its part has its bottom part 12*a* (see FIG. 3) joined to the sole 8 of the hard shell 5 so that the U-like base part 12 is a part of the hard shell 5. In back part of the boot sole 8, which is formed by the sole 8, of the hard shell 5, there is a box-like take-up space 16 that in cross section is generally rectangular and has an inner size of for example 61 by 16 by 125 mm for resilient compression element 10 with an overall size of for example 58 by 14 by 130 mm and a gross density of, for example, 550 g/l.

The levers 3 of the flat steel strip have a relatively small cross section of for example 1 by 30 mm, the spring steel thereof being doubly grooved in the length direction with a groove depth of 2 mm. This cross section is so small that it hardly makes the back part of the boot by some milimeters broader, without influencing the function negatively. The levers 3 can be made of either glass or carbon fiber-reinforced resin. Levers **3*b* over the pivot point 9 of the lever 3 are joined up with the cuff 4 which is twist resistant, that is placed only around the lower leg (not figured) and not the hard shell 5, the latter forming generally the lower part of the upper. The cuff 4 angles forward towards the toe of said boot 1 without friction in relation to shell 5. Lengthway groovings of the levers 3 in connection with said cuff 4 make certain that the upper in sideways direction is limited to less than 2° in relation to the boot sole 8 when skiing. When the skier bends his lower legs forward, the lower ends of the levers 3*a* of the levers 3 will be moved towards the heel of the boot 1. The levers 3*a* are angled in direction to the toe of said boot 1 under the pivot point 9 by 50% of the amount of bending of the lower leg of 40°, that is by 20° in relation to the levers 3*b*. This angling form reduces the distance between the lower ends of the levers 3*a* which are turned into the broader, outwardly curved part of the upper placed around the foot and placed over the relatively narrow sole region 18 in the back of said boot 1. An element for the transmission of compressive force is joined with the lower ends of the levers 3*a* by way of a cord 14. This element has a compressive element 15 and a push rod 22, whose one is joined to the compressive element 15 and whose other end is joined with a push slide 21. These parts are placed to the front of a resilient compression element 10. When the lower leg is bent forwards said element 10 is pressed together. Said element is made of a cellular, resilient material. Besides the push rod 22 in the front region of the sole 8, it is possible to have further compression elements 10*a* and 10*b*, which are lower in height, due to the low form of the sole region 18, than the compression element 10 placed in the back region of the sole 8. The pulling cord 14 may have its place taken by a rod-like pulling rod 11 if desired. Said rod 11 may for example be joined at its pivot point to the lower end of the levers 3*a* by means of a pin or a screw. If a connection pin is used, it may be guided in a guide slot (not figured), the slope of the slot and the curved form thereof controlling the path of motion of said rod 11. The transmission of force between the levers 3*a* and the compression element 10** may furthermore be replaced by a hydraulic system of parts that are not figured here.

The compressing force on the compression element 10, and for this reason the resistance with respect to a lower leg which is bent forwards, may be adjusted by changing the height of the point at which the parts 11/14 are joined to the side-pieces of the levers **3*a* and the density and the size of the said compression elements 10, 10*a* and 10*b* for a given size of a take-up space 16 (see FIGS. 1+2). Some of the compression elements 10*a* and 10*b* seen in FIG. 2 may be exchanged for e.g. solid rubber elements or like resilient material to modify the hysteresis curve of all said compressible elements. The compression element 10 is separated and walled off from the compression elements 10*a* and 10*b* by a separating wall 16*e***.

A twist-resistant or torsionally stiff cuff 4 gripping the lower leg from the back and for this reason reinforcing the sides of the upper is so joined with the side pieces **3*b* of said levers 3 that it may be changed in angle so that the legs of a bow-legged or knock-kneed person may be given support in the ski boot 1**.

A foam boot liner or inner shoe 2 is positioned within the hard shell 5. A light-weight cover 6 made of a snow-tight textile fabric which is used for joining together the relatively soft edge lips **5*a* and 4*a* of the hard shell 5 and the cuff 4. In place of this it is possible to have a replaceable inner shoe (not figured) that is fitted around the foot and the lower leg and has a snow-tight resilient outer skin that bridges the gap between said shell 5 and said cuff 4**.

The take-up space 16 is covered by an upper wall 17 in the front and back parts in the sole region in such a way that the compression elements 10, **10*a* and 10*b*** may be readily replaced.

Between the inner walls of the take-up space 16 and the outer faces of the compression element 10 there is a free space whose size will effect the hysteresis curve. The greater the size of this free space, the later the point in time that the hysteresis curve begins to increase progressively. Furthermore, the form of the hysteresis curve may be changed by having the long sides of the compression elements 10, **10*a* and 10*b* not running parallel to the lengthways axis of the boot 1** and the direction of the said compression element.

It would furthermore be possible for the end wall **16*a* of the take-up space 16, that is opposite to the end at which the compressive force takes effect, to have a ferrule-like element 13 placed against it, that is placed around said element 10 for a part of its length on two or four sides thereof, and may be adjusted by a screw 16*b*** to have an effect on the form of the hysteresis curve.

Figure 2:
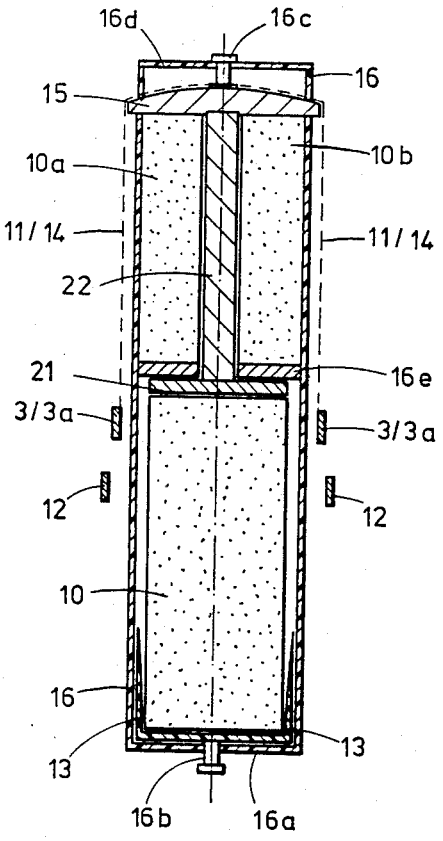
FIG. 2 is a part of a section on the line II—II of FIG. 1.

All the compression elements 10, **10*a* and 10*b* may be given a certain degree of pre-stress, to which end there is an adjustment screw 16*c* in the front end wall 16*d* of the take-up space 16, the screw 16*c* acting on the pressure transmission element made of the parts 15, 22 and 21 (FIG. 2**).

A part of the hard shell 5 supporting the foot has a foot-like shape so that it will not be necessary to have a relatively thick, cushion-like inner shoe. For this reason the foot is more accurately positioned and gripped within the boot 1 (not figured).

Figure 3:
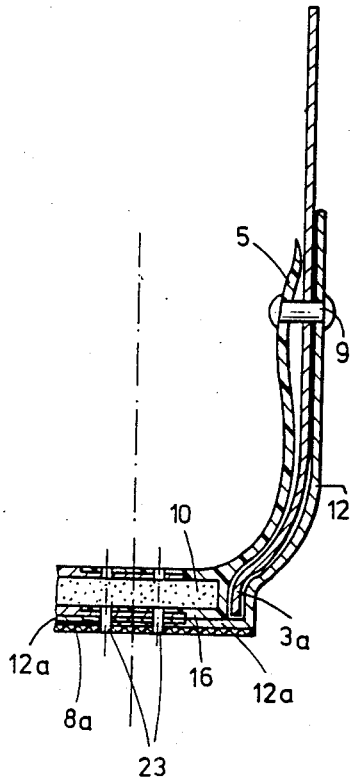
FIG. 3 is a part of a section on the line III—III of FIG. 1.
Figure 4:
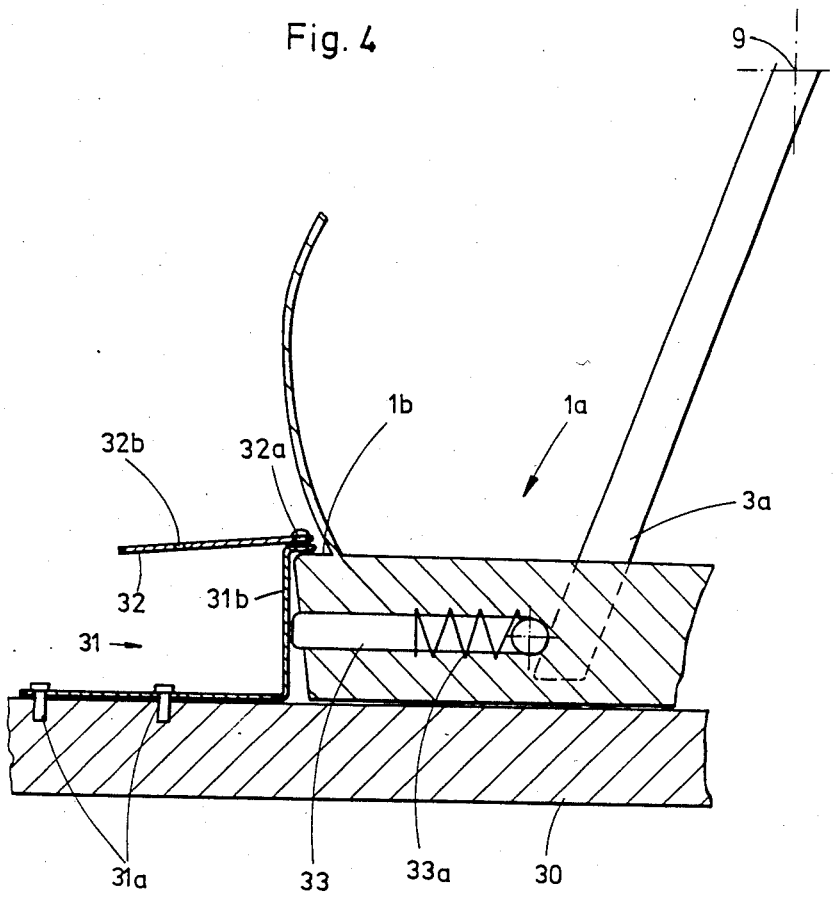
FIG. 4 is a view of part of a fastener joining heel to ski.

The U-like base part 12 is made up of two parts that are able to be joined together by way of the bottom part **12*a* so that they may be undone and then adjusted in width (see FIG. 3). The U-like base part 12 has the function of stiffening the sides of the upper. With this design (using said cuff 4, said levers 3 and the hard shell 5 stiffened by the base part 12**) one may be certain of getting high moments of resistance to loads acting against the sides of the upper. Even turning a knee inwards only a bit gives an exact ski-edging effect and a reduction of bending of the body at the hip. Strong side bending of the hip is generally undesireable from the orthopedic point of view.

A binding 31, having for example a doubly bent strip spring **31*b* (see FIG. 4) has one of its ends fixed by screws 31*a* to the ski 30, while its other ends keeps down the heel 1*b* of the boot 1 on the ski 30**. The lower end 3*a* of levers 3, after being rocked as far as its limit, takes effect on a release part 33 or sliding bolt, thus freeing the boot heel 1*b*. A return spring 33*a* is responsible for returning the release part 33 back after it has functioned. For releasing the ski boot heel 1*b* from the ski 30 by hand using a ski pole there is for example a further flat strip spring 32 that is riveted at 32*a* to the spring 31*b*. The spring 32 has a hole 32*b* for the point of the ski pole for opening the binding when desired. The flat strip springs 31*b* and 32 are made of stainless spring steel, although the use of another spring material would be acceptable. It is obvious that this automatic binding-opening function as dependent this automatic binding-opening function as dependent on the forward bending of the lower leg, in the new ski boot design of the invention is safer than other by weight releasable bindings.

Figure 5:
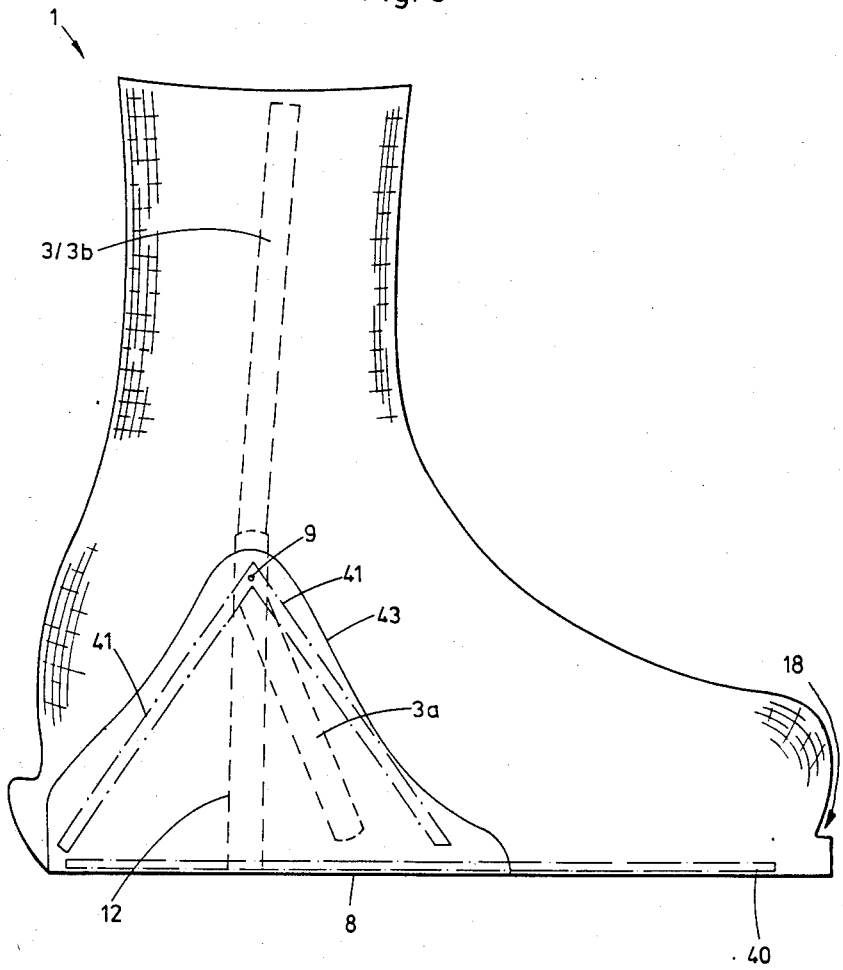
FIG. 5 is a view of reinforcing cores used in the boot of the invention.

As FIG. 5 shows the side walls of the upper or of the hard shell 5 may in addition be reinforced. To this end there are reinforcing cores 41 embedded in the said walls running from a point near the pivot point 9 of the levers 3, the reinforcing cores running at a slope downwards towards the heel and the sole part of the boot sole 8 of the hard shell 5. These said reinforcing cores 41 may have a rectangular cross-section and be made of fiber-reinforced resin and furthermore be joined with reinforcing cores 40 in the boot sole 8.

However, the reinforcing cores 41 may also be embedded in a resin injection molding 43, that is fixed on the outside of the hard shell 5 so that it may be removed and exchanged when desired. In this case the reinforcing cores may furthermore be made of spring steel wire, and they will then be especially light, so that, due to their well-known high modulus of elasticity, they will allow a great increase in the stiffness of the boot 1 and make possible a further decrease in the weight of other parts of the ski boot 1 with which they are joined.

The different parts 3, 5, 10, 10*a*, 10*b*, 11, 12, 14, 21, and 22 of the boot 1 may be so joined together that they may be removed and replaced by other parts of the same function.

Figures 6, 7:
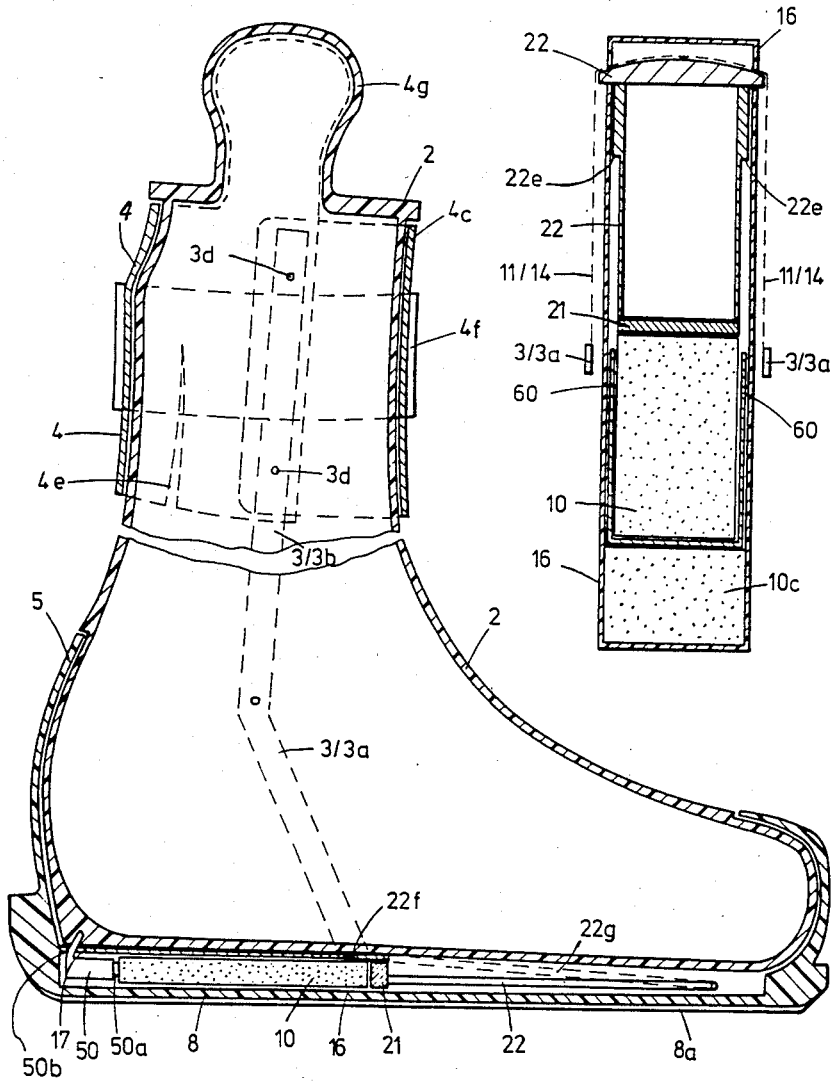
FIG. 6 is a longitudinal section through a ski boot.
FIG. 7 is a longitudinal section through a resilient compression element.

FIG. 6 is a view of the ski boot 1 with a rear twist-resistant stiff cuff part 4, that is joined with the levers 3/3*b*. It has slots 4*e* running away from said sole 8. A front stiff U-like cuff part 4*c* covers with its side-pieces, the back cuff part 4 so that the lower leg (not figured) is gripped to the front and to the back of the lower leg. When said cuff part 4*c* is pushed towards the toe of the boot by the lower leg in the boot 1, its slots 4*e* in the back part of said cuff part 4 will be pushed together by a strap 4*f*, so the slots become narrower and are pressed against the skin of the user of the boot 1, then feeling by way of his skin the changes in force acting on the ski tips. This ability to use a large surface of the skin for sensing information with respect to the motion of the skis is useful, particularly if (as part of a still further development of the invention) the cuff is only placed around the top quarter of the lower leg. The force or pressure acting in said upper quarter cuff is then small in comparison with lower-placed cuffs.

In place of the rear cuff part 4 the U-like front cuff part 4*c* is joined with the levers 3/3*b* as well, and then the side-pieces of the rear cuff part 4 laterally overlap with the front cuff part 4*c*. A strap 4*f* surrounds the cuff parts 4 and 4*c*. Then the user will no longer have any feeling of the ski motion through his skin but instead he will then be able to put his foot into the boot 1 from the back. One of the cuff parts 4 or 4*c* has an upwardly pointing prolongation 4*g* on the inner side of the knee (not figured). This prolongation 4*g* is placed snugly against the knee so that the knee must only move a small distance inwards for edging the ski. In the case of lower cuffs that do not grip the lower leg exactly, the edging effect may be produced by a rotation of the upper leg and the knee using a motion of the back (hip bend) as well. The outcome of this has in the past been permanent damage to the vertebral column, but with the said prolongation 4*g* of the cuff there will be less load not only on the vertebral column, but on the knee as well.

The take-up space 16 for the resilient compression element 10 has air inlet openings 50*a* and outlet openings 50*b*, that are placed in a rubber bladder 50 so that air is pumped out of the take-up space 16 into an inner shoe 2 or liner when the skier changes his knee angles while moving. The rubber bladder 50 is pressed by the resilient compression element 10. Without the rubber bladder 50, if the inlet valve 50*a* and the outlet valve 50*b* are placed in common in the take-up space 16 or in the top wall 17 of the said take-up space 16, then the slide 21 is in the form of a piston. In every case air is pumped out of the take-up space 16 and pumped into the inner liner 2. This keeps water from condensing in the take-up space 16, and the liner 2 is aired.

In keeping with the outline of the lower leg the cuff 4 has its smallest diameter in its top part.

In FIG. 7 are seen two cellular resilient compression elements 10 and 10*c* that are housed in the take-up space 16. The compression element 10*c* is made of polyurethane foam with a gross density of 700 g/l and fully takes up all of the space 16, whereas the body 10 with a gross density of 650 g/l is placed loosely in front of it with some free space in the take-up space 16 and has the U-like limiting part 60 placed on three sides of it. The ends of the legs of the force limiting part 60 are rested against a driver element guide 22*e* so that the compression element 10 may be squeezed together a certain amount from the front and said element 10*c* is the only part responsible for a steep progressive increase in the resistance. Using such a design, it is possible to make a further change in the resistance function for a lower leg bending forwards in the boot 1. In the case of forward bending of the lower leg the forces are transmitted from the pivot point 22*f* of the lever leg 3/3*a* by way of the many-part force transmission element 22*g*, 22 and 21 in the front part of the sole from the front to the resilient compression element 10 and 10*c*, the parts 21 and 22 of the force transmission element being able to be moved lengthways in the take-up space 16 (see FIG. 6).

The technical effect of the invention may be looked upon as making the optimal use of the small amount of available space in a ski boot for moving parts and to further accomodate all desired functions of the ski boot (resistance of the cuff equal to Nm 200, able to be bent forwards to about 40° and laterally stiff). The boot will be lower in price, lighter in weight, easily modifiable and very durable. The boot furthermore will maximize the skier's energy use, as well as a ski binding with an exceptionally safe release.

I claim:

1. A ski boot comprising a hard shell for taking up the foot, a cuff for gripping the lower leg and forming said boot cuff, said cuff being pivotally joined at hinge points to said hard shell and having prolongations running past said hinge points towards a sole of said hard shell, resilient compressive means placed in a back part of said sole, said prolongations being joined with said means for producing resistance to forward bending of said leg, said resistance increasing with forward bending, wherein said compressive means consists of at least one compression resilient element made of cellular resilient material, said resilient compression element being placed in a take-up space in a back part of said sole of said hard shell, that a slide is placed in front of at least one said compression element for the transmission of compressive force thereto, said prolongations being in the form of laterally stiff levers with lower ends thereof joined to said slide functionally, said levers having upper ends joined with a stiff cuff.

2. The ski boot as claimed in claim 1 wherein said levers are made of flat strip spring material.

3. The ski boot as claimed in claim 2 wherein said cuff is torsionally stiff.

4. The ski boot as claimed in claim 1 wherein the parts which are joined together to build said ski boot are exchangeable joined for the purpose of replacing worn out parts with new parts.

5. The ski boot as claimed in claim 1, having a shut-off take-up space with walls in said sole part to take up said resilient compression element whereby said walls cause increasing of said resistance, which occurs through steady forward bending of said skiers leg when the sides of said compression element touch said walls of said shut-off take-up space.

6. The ski boot as claimed in claim 1, wherein at least one resilient compression element, which is placed in said take-up space of said sole is made of cellular polyurethane elastomer.

7. The ski boot as claimed in claim 1 wherein part of said levers between on the sole side and said hinge points on said shell are angled towards a toe of said boot through an angle equal to roughly 50% of the amount of possible forward bending of said boot cuff.

8. The ski boot as claimed in claim 1 further comprising a ferrule-like device placed on at least one compression element for a part of its length.

9. The ski boot as claimed in claim 8 wherein said ferrule-like device may be adjusted in the direction of said compressive force.

10. The ski boot as claimed in claim 1 comprising a number of such compression elements, said elements having different characteristics.

11. The ski boot as claimed in claim 1 comprising an U-like base part pivotally joined with said levers, said base part having a bottom part joined and fixed to the sole part of said hard shell.

12. The ski boot as claimed in claim 1 wherein said cuff is torsionally stiff and has a back part fitting around the back of the lower leg and joined adjustably with top ends of said levers so that the lateral angle thereof of said levers may be changed.

13. The ski boot as claimed in claim 12 wherein said cuff is designed for gripping the lower leg only in a top quarter thereof.

14. The ski boot as claimed in claim 1 wherein said cuff has two U-like parts, one for gripping the lower leg from the back and laterally and one for gripping the lower leg from the front, whose side pieces overlap on two sides the cuff from the back and from the sides.

15. The ski boot as claimed in claim 14 wherein one side of said cuff has a prolongation running along the inner side of a knee of said leg in the boot.

16. The ski boot as claimed in claim 15 wherein said cuff has generally parallel slots running away from said sole.

17. The ski boot as claimed in claim 5 having air inlet and outlet openings running into and out of said take-up space for ventilation purposes of said take-up space.

18. The ski boot as claimed in claim 1 comprising a pressure limit part for limiting compression of at least one compression element.

19. The ski boot as claimed in claim 1 comprising reinforcing parts with cores for reinforcing said hard shell and said stiff, said cores having a high specific strength.

20. The ski boot as claimed in claim 1 comprising a sliding release part with one end thereof pointing outwrads for latching said boot to a ski binding, said release part being placed in a heel part of said boot, a further end of said release part pointing towards said levers and being so placed in relation thereto that at the forward limit of a bending range of said leg said release part is moved by said levers for freeing said boot from said binding.

* * * * *